US005643008A

United States Patent [19]

Tan et al.

[11] Patent Number: 5,643,008

[45] Date of Patent: Jul. 1, 1997

[54] SYSTEM FOR ARRANGEMENT OF DIFFERENT INPUT/OUTPUT CONNECTORS

[75] Inventors: Haw-Chan Tan; Frank C. Ma, both of Diamond Bar, Calif.

[73] Assignee: Hon Hai Precision Ind. Co., Ltd., Taiwan

[21] Appl. No.: 524,333

[22] Filed: Sep. 6, 1995

[51] Int. Cl.[6] ..... H01R 13/60

[52] U.S. Cl. ..... 439/541.5; 439/701

[58] Field of Search ..... 439/541.5, 540.1, 439/638, 701, 79, 80, 63, 581

[56] References Cited

U.S. PATENT DOCUMENTS

| | | | |
|---|---|---|---|
| 5,037,330 | 8/1991 | Fulponi et al. | 439/79 |
| 5,046,952 | 9/1991 | Cohen et al. | 439/79 |
| 5,062,811 | 11/1991 | Hackman | 439/620 |
| 5,085,590 | 2/1992 | Galloway | 439/541.5 |
| 5,336,109 | 8/1994 | Hillbish et al. | 439/541.5 |
| 5,401,192 | 3/1995 | Briones et al. | 439/639 |
| 5,445,483 | 8/1995 | Fultz | 411/181 |

*Primary Examiner*—Gary F. Paumen
*Assistant Examiner*—T. C. Patel

[57] ABSTRACT

A system (10) for arrangement of a D-Sub connector (60) and three audio jacks (34), includes an insulative bracket (12) generally comprising an upper section (14) and a lower section (16). The upper section (14) includes a pair of securement posts (18) defining a D-Sub receiving space (19) therebetween for attachment of a D-Sub connector (60) thereto. The lower section (16) includes a jack assembly receiving cavity (29) with latching lugs (28) aside for locking the jack assembly (30) therein wherein a plurality of openings (25) are formed in the front portion (21) for allowing the mating portions (42) of the audio jack assembly (30) to extend forward. The system (10) further includes a pair of boardlocks (54) which not only secures the D-Sub connector (60) to the bracket (12) but also retains the whole system (10) on the mother board in position.

22 Claims, 8 Drawing Sheets

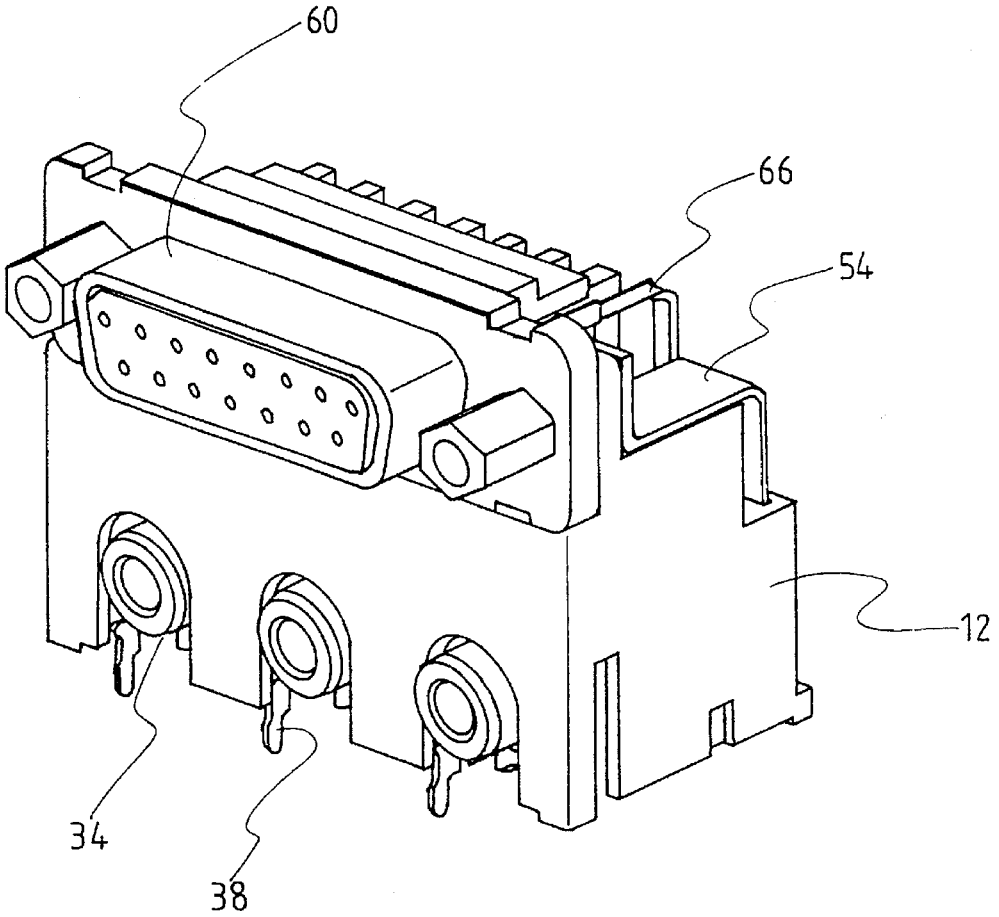
10
FIG,2

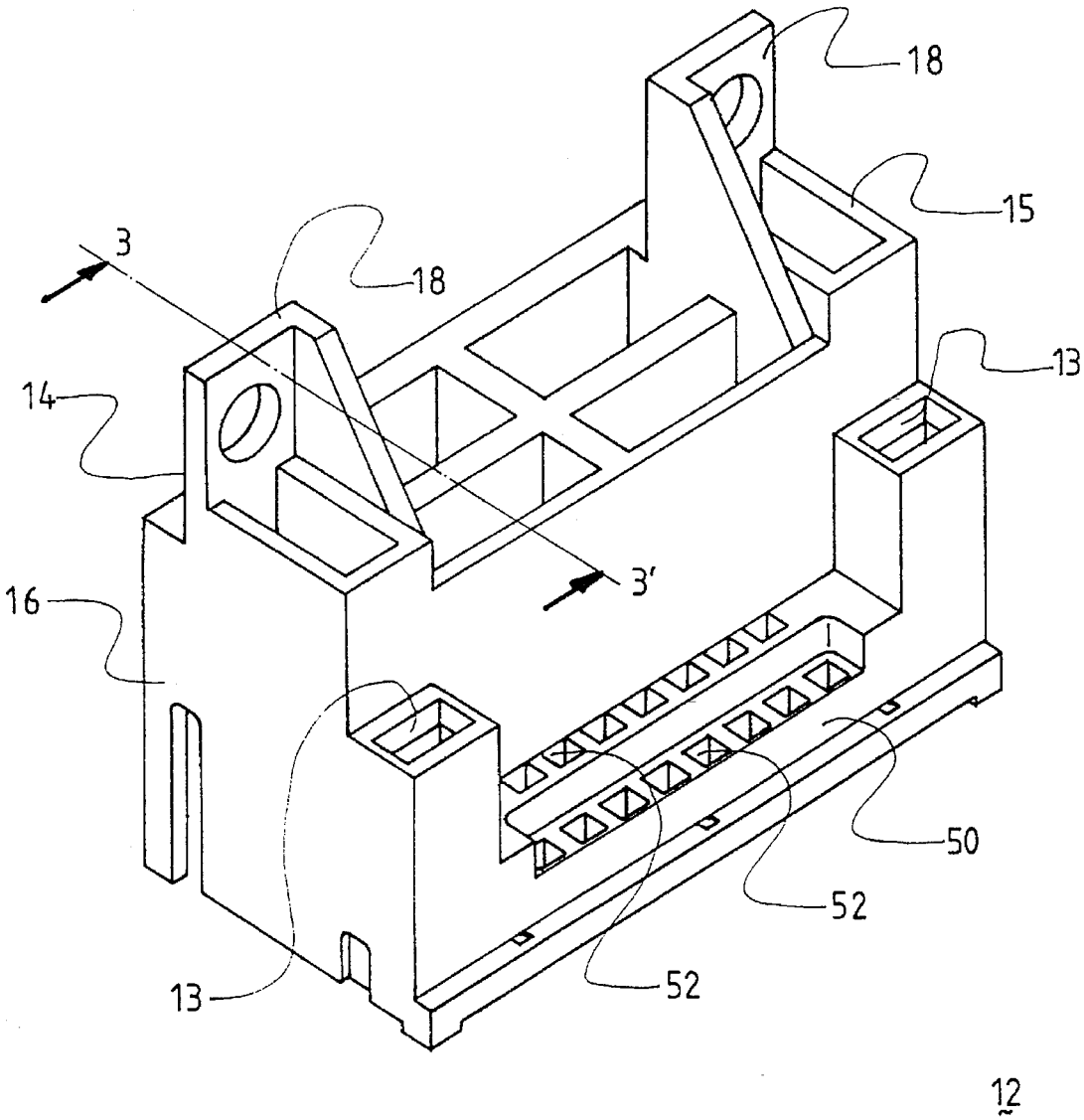
FIG,3

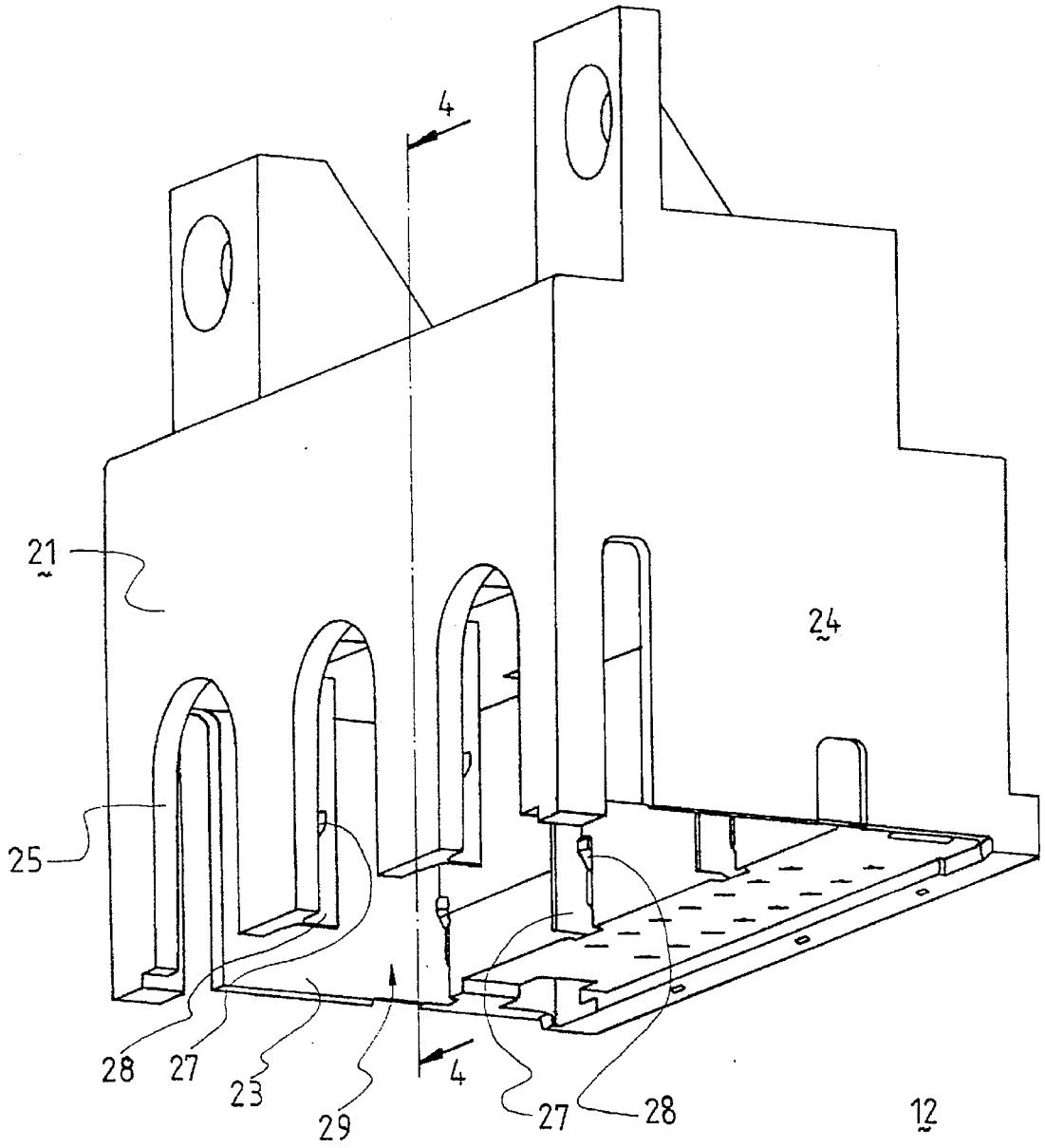
FIG, 4

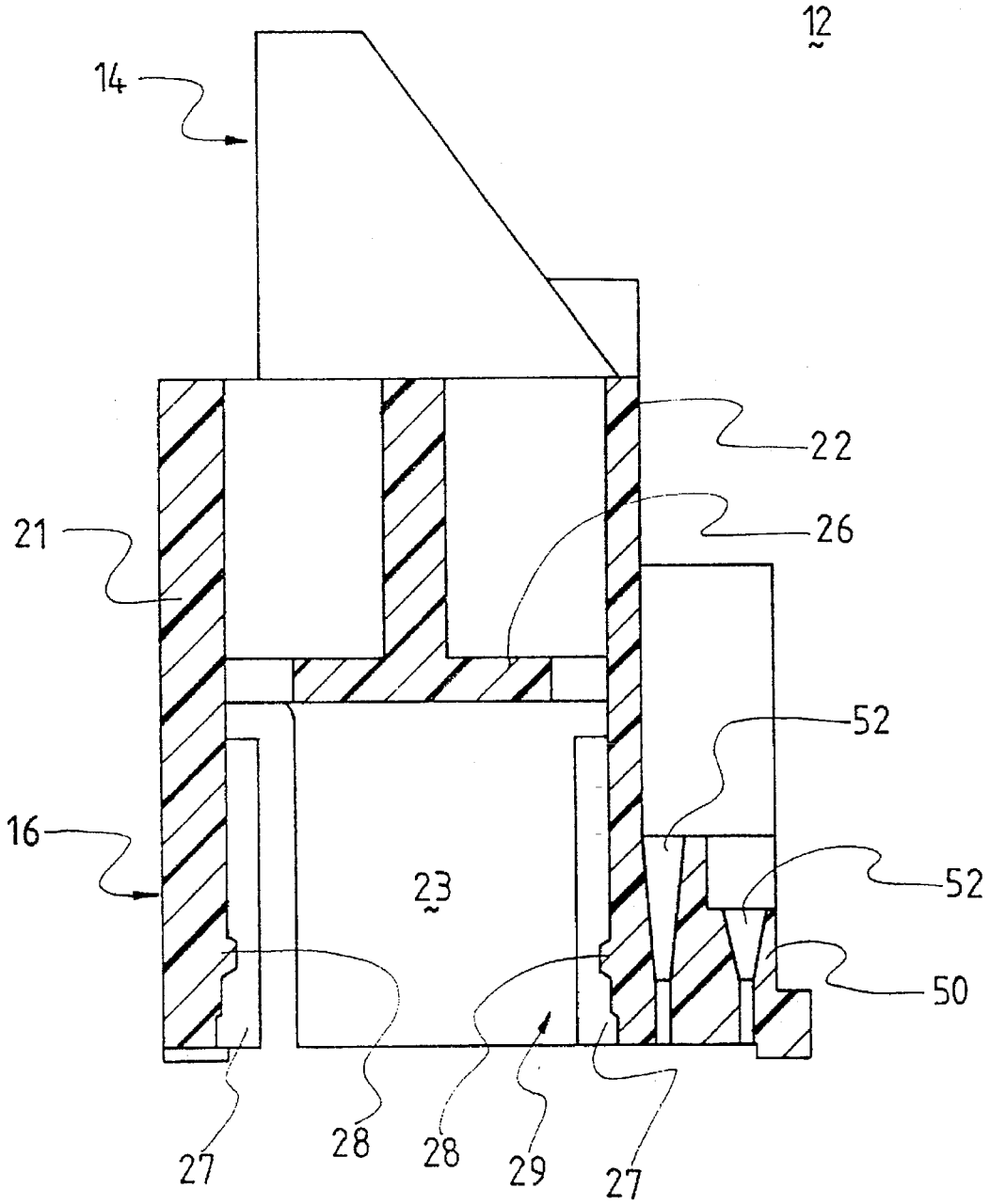
FIG, 5

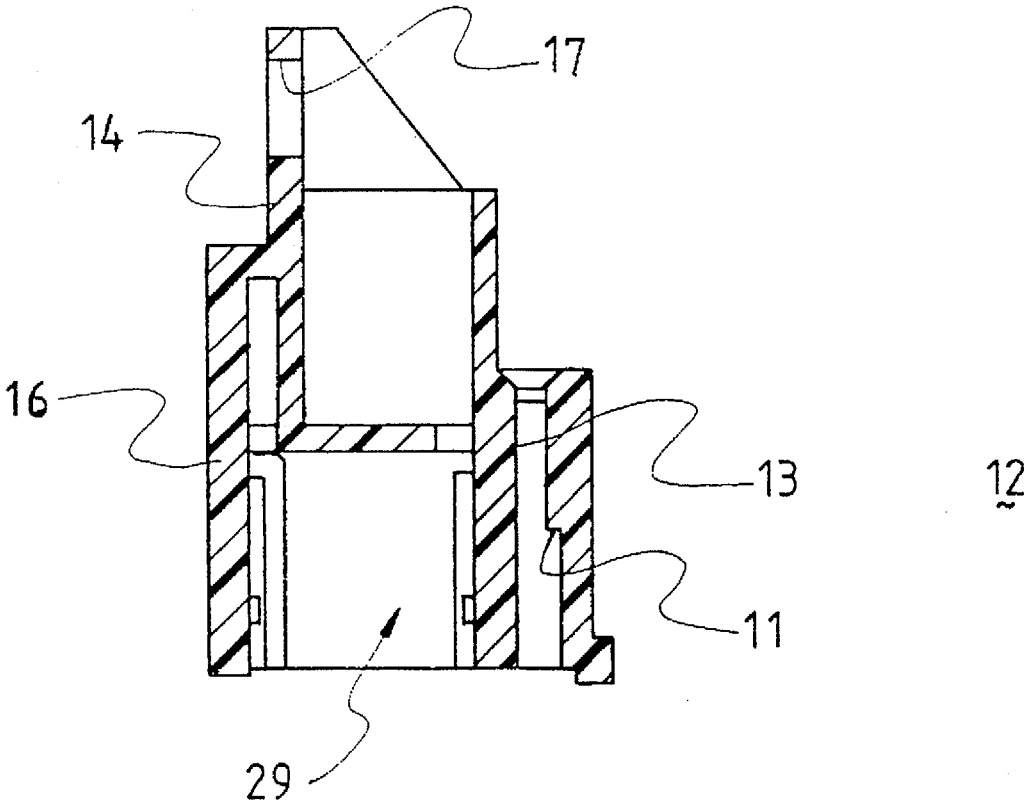
FIG, 6

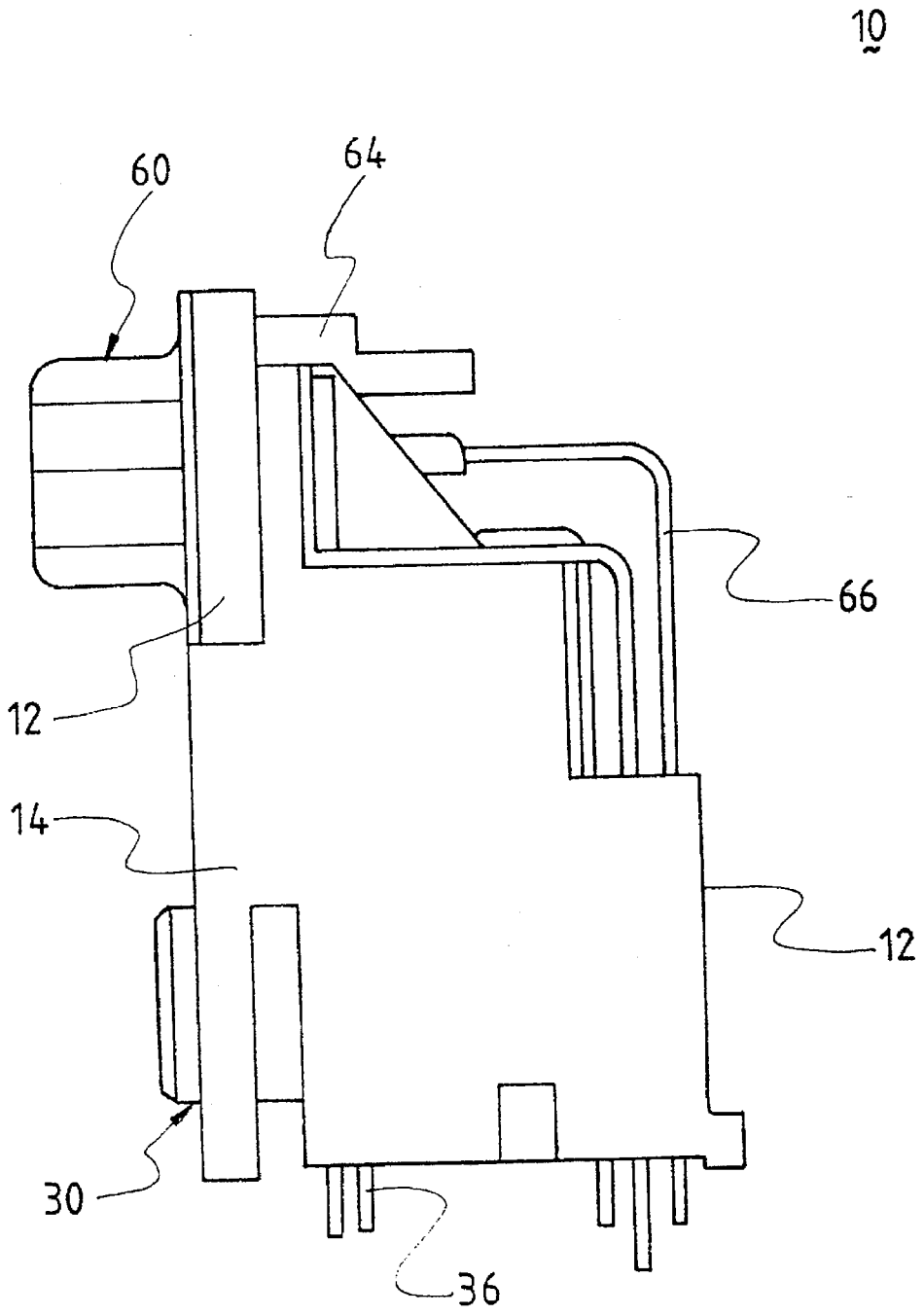
FIG,7

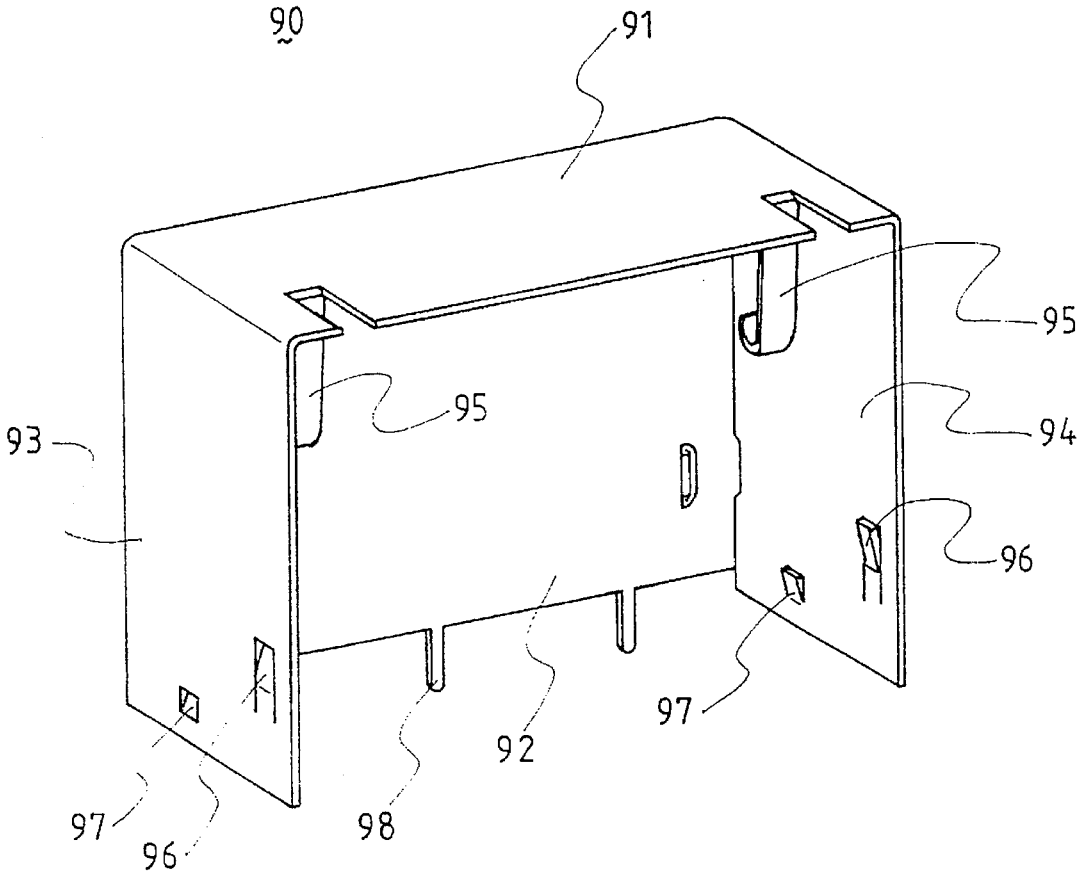
FIG, 8

SYSTEM FOR ARRANGEMENT OF DIFFERENT INPUT/OUTPUT CONNECTORS

BACKGROUND OF THE INVENTION

1. Field of the Invention

The invention relates to a system for arrangement of different I/O connectors, particularly to an arrangement of an elongated D-Sub connector and three associated audio jacks together for easy approaching and for space saving on the backpanel region of the computer case.

2. The Prior Art

The multi-media devices are commonly attached to the computer system, and thus the audio jacks are popularly used in the computer. The conventional arrangement of the audio jacks to the computer case, is set in alignment with the D-Sub connector, which is a basic device in the computer, in a lengthwise direction along the D-sub housing. Understandably, this type arrangement takes too much space on the mother board in the computer in such a lengthwise direction, and also results in numerous installation jobs of such audio jacks and the D-Sub connector because such audio jacks and D-Sub connector are substantially of individual type. Based on the fact that the space within the computer is so critical under the consideration of miniaturization trend, some attempts have been taken to integrate the housing of the different connector as one piece for achieving some advantages, as disclosed in U.S. Pat. Nos. 5,401,192 and 5,407,366.

Anyhow, the design of such attempts still occupy too much dimension in a lengthwise direction. Therefore, an object of the invention is to provide a system for arrangement of a D-Sub connector, which is a basic Input/Output device of the conventional computer, and three audio jacks, which are designedly connected to devices of multi-media, wherein such arrangement may keep the minimum dimension or the compact size of the occupation of such D-Sub connector and three audio jacks for compliance with miniaturization.

Another object of the invention is to provide an arranged one piece system including thereof D-Sub connector(s) and plural jacks in position so that it is very convenient for the computer manufacturer to directly load such system on the mother board and solder the tails of the contacts of the D-Sub connector and of the jacks onto the board successively, in place of the prior process which requires to load the individual jacks and D-Sub connector respectively for the successive soldering. Thus, the labor and time can be saved for the computer manufacturer by using the present invention.

SUMMARY OF THE INVENTION

According to an aspect of the invention, a system for arrangement of a D-Sub connector and three audio jacks, includes an insulative bracket generally comprising an upper section and a lower section. The upper section includes a pair of securement posts defining a D-Sub receiving space therebetween for attachment of a D-Sub connector thereto. The lower section includes a jack assembly receiving cavity with latches aside for locking the jack assembly therein wherein a plurality of openings are formed in the front portion for allowing the mating portions of the audio jack assembly to extend forward. The system further includes a pair of boardlocks which not only secures the D-Sub connector to the bracket but also retains the whole system on the mother board in position.

BRIEF DESCRIPTION OF THE DRAWINGS

FIG. 2 is a perspective view of the system of FIG. 1 including the assembled D-Sub connector and the audio jack assembly therein wherein only some contacts of the audio jack assembly are shown thereof for illustration.

FIG. 3 is a back perspective view of the bracket of the system of FIG. 1 to show the rear portion thereof.

FIG. 4 is a bottom perspective view of the bracket of the system FIG. 1 to show the lugs therein for retaining the jack assembly within the bracket.

FIG. 5 is a cross-sectional view of the bracket of the system of FIG. 1 to illustrate the interior structure thereof.

FIG. 6 is a cross-sectional view of the bracket of the system of FIG. 1 to show a step formed within the boardlock receiving channel for prevention of upward movement of the boardlock.

FIG. 7 is a side view of the system of FIG. 1.

FIG. 8 is a perspective view of a shield for use with the system of FIG. 1, which may be optionally attached to the bracket of the system of FIG. 1.

DETAILED DESCRIPTION OF THE PREFERRED EMBODIMENT

Figure 1:
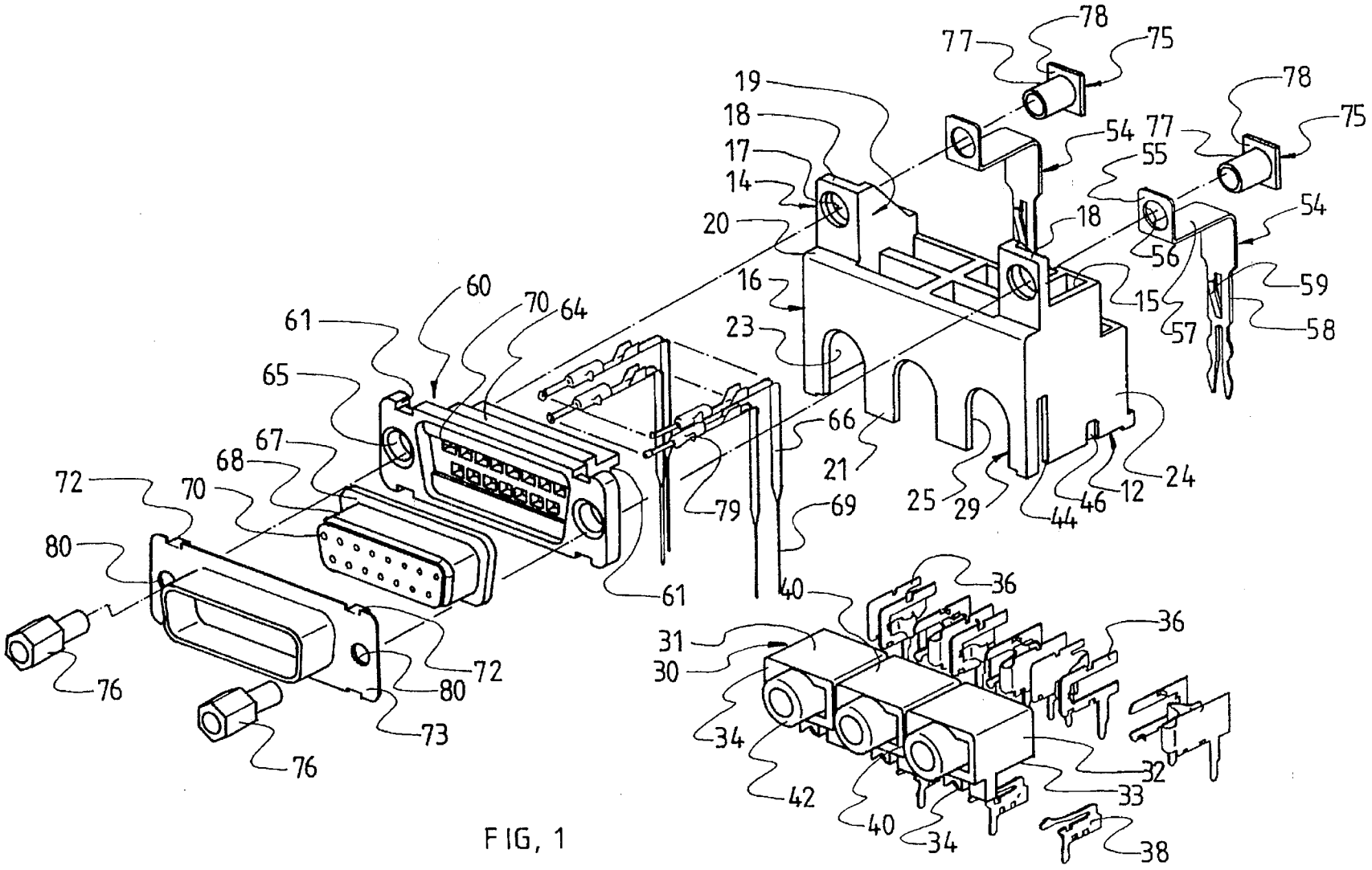
FIG. 1 is an exploded perspective view of a system for arrangement of a D-Sub connector and an audio jack assembly, according to the present invention.

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is now directed to FIG. 1, wherein a system 10 for arrangement of the D-Sub connector and an audio jack assembly includes an insulative bracket 12 defining an upper section 14 and a lower section 16. The upper section 14 includes a pair of securement posts 18 each having an hole 17 therein for receiving a clinch nut 75 therein. An engagement shoulder 20 is formed on the front portion of the upper section 14 for supporting a housing 62 of a corresponding D-Sub connector 60 thereon. Such pair of securement posts 18 defines a space 19 therebetween in a lengthwise direction to allow the rear portion 64 of the housing 62 of the D-Sub connector 60 and the associated contacts 66 of the D-Sub connector 60 to extend rearward.

The D-Sub connector 60 includes the housing 62 and an mating block 68, which is positioned in front of the housing 62, both defining a plurality of passageways 70 for receiving a corresponding number of contacts 66 therein. A shell 71 is securely attached to the housing 62 on the front face via locking tabs 72 of the shell 71 embedded within the corresponding recesses 61 in the housing 62. Thus, the expansion portion 67 of the mating block 68 is snugly received within a pan-like recess 63 in the front portion of the housing 62, and the expansion portion 67 of the mating block 68 can be sandwiched between a plate section 73 of the shell 71 and the housing 62 certainly in a secure position.

A pair of clinch nuts 75, each including a circular section 77 and a plate section 78, are designed to secure not only the shell 71 to the housing 62, but also such D-Sub connector 60 to the bracket 12, by means that the circular sections 77 of the clinch nuts 75 extend through the securement holes 17 of the securement posts 18 and the aligned holes 65 of the housing 62 and the aligned holes 80 of the shell 71 of the D-Sub connector 60 wherein the distal end of the circular section 77 of each clinch nut 75 is then formed as a rivet head for abutting against the plate section 73 of the shell 71, so that the D-Sub connector 60 not only itself is assembled, but also securely fastened to the bracket 12 in position.

A pair of female screw locks 76 are received within the corresponding circular sections 77 of the clinch nuts 78, respectively, whereby a pair of screws (not shown) associated with the complementary cable connector (not shown) may latchably secured into such pair of female screw locks 76, respectively.

Referring to FIGS. 1, 4 and 5, opposite to the upper section 14, the lower section generally includes a front wall 21, a rear wall 22 and two opposite side walls 23, 24 and an internal horizontal plate 26 commonly defining therein a cavity 29 facing downward wherein three arch openings 25 are formed in the front wall 21. Referring to FIGS. 4 and 5, in the cavity 29, two pairs of separating blades 27 and a pair of latching lugs 28 are formed by two sides of each blade 27.

A triplex audio jack assembly 30 has an integral insulative body 32 defining three units 34 thereof wherein each unit 34 generally comprises a simplex audio jack having four contacts 36 and one grounding pin 38 therein. A groove 40 is formed between every two adjacent units 34 for receiving the corresponding blades 27 therein for orientation of the audio jack assembly 30.

When assembled, the D-Sub connector 60 may be loaded to the bracket 12 from the top under the condition that the rear portion 64 of the housing 62 thereof is aligned with the space 19 between the two securement posts 18, until the housing 62 is seated on the engagement shoulder 20 of the bracket 12. As aforementioned, the D-Sub connector 60 can be secured to the bracket 12 through such pair of clinch nuts 75. Oppositely, the triplex audio jack assembly 30 is loaded to the bracket 12 from the bottom under the condition that the blades 27 in the cavity 29 are snugly received within the corresponding grooves 40 in the body 32 of the triplex audio jack assembly 30, until the top surface 31 of the body 32 of the audio jack assembly 30 confronts the bottom surface of the middle horizontal plate 26 and the bottom surface 33 of the body 32 of the audio jack assembly 30 pass the lugs 28 in the cavity 29. Thus, the audio jack assembly 30 is retained in the cavity 29 by means of the lugs 28 of the bracket 12 butting against the bottom surface 33 of the body 32 of the audio jack assembly 30. Under this situation, the mating portion 42 of each unit 34 of the audio jack assembly 30 is adapted to project out of the corresponding opening 25 of the bracket 12 for coupling to the complementary cable connector (not shown). The assembled system 10 can be referred to FIGS. 2 and 7.

Referring to FIGS. 3, 5 and 7, the bracket 12 further includes a spacer block 50 integrally extending rearward from the rear wall 22 and having a corresponding number of orifices 52 extending therethrough vertically for alignment of the tails of the contacts 66 of the D-Sub connector 60 with regard to the board (not shown) on which the system 10 is mounted.

Referring to FIGS. 1, 3, 6 and 7, the system further includes a pair of mounting boardlocks 54 on two sides for securing the bracket 12 onto the board wherein each mounting boardlocks 54 includes a vertical section 55 having a hole 56 therein in alignment with the hole 17 of the corresponding securement post 18 and sandwiched between the plate section 78 of the clinch nut 75 and the securement post 18. A horizontal section 57 of the mounting boardlock 54 is generally seated on the support surface 15 of the securement post 18, and a leg section 58 extends downward from the horizontal section 57 and into a holding channel 13 of the bracket 12 wherein a tang 59 of the leg section 58 engages an internal step 11 (FIG. 6) in such holding channel 13 for preventing upward movement of the leg section 58.

Referring to FIGS. 1 and 8, the system 10 may optionally include a shield 90 including a top surface 91, a rear surface 92 and two side surfaces 93, 94 for covering the bracket 12 wherein the top surface 91 includes a pair of grounding tangs 95 downward extending to engage the back surfaces of the plate sections 78 of the clinch nuts 75, and the side surfaces 93, 94 further include locking tags 96, 97 for engagement with the slots 44, 46 in the side walls 23, 24 of the lower section 16 of the bracket 12.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A system for arrangement of different Input/Output connectors, comprising:

a bracket including an upper section and a lower section;

a first connector means loaded to the upper section from the top and secured to the upper section;

a second connector means loaded to the lower section from the bottom and secured to the lower section; and said first connector means and said second connector means including a plurality of contacts extending downward, respectively; wherein said lower section comprises a front wall, a rear wall and two side walls defining therein a cavity facing downward for allowing bottom loading of the second connector means, and said second connector means is an audio jack assembly including a body composed of a plurality of units which are retained in said cavity by lugs of the bracket.

2. The system as described in claim 1, where the bracket includes a plurality of blades for reception within a plurality of grooves between two adjacent units.

3. The system as described in claim 1, wherein the lower section of said bracket further includes a plurality of openings in the front wall in alignment with the units of the audio jack assembly, respectively.

4. The system as described in claim 1, wherein said bracket further includes a spacer block integrally extending rearward from the lower section.

5. The system as described in claim 1, wherein said system further includes a shield attached to the bracket.

6. The system as described in claim 1, wherein said upper section comprises a pair of securement posts defining a space therebetween for receiving a rear portion of said first connector means.

7. The system as described in claim 6, wherein said first connector means is a D-Sub connector adapted to be fastened to the upper section of the bracket by means of a pair of clinch nuts extending through the corresponding securement posts and an insulative housing of said D-Sub connector.

8. The system as described in claim 6, wherein a pair of mounting boardlocks are fixed to said pair of securement posts, respectively.

9. The system as described in claim 8, wherein each of said boardlocks includes a vertical section sandwiched between the bracket and a plate section of a clinch nut.

10. The system as described in claim 9, wherein each of said boardlock further includes a mounting leg having tangs latchably engaged within a channel in the bracket.

11. A system for arrangement of different connectors having different lengthwise dimensions, comprising:

a bracket including a first section and a second section and defining a lengthwise direction;

a first connector means adapted to be secured to the first section;

a second connector means including an integral body generally integrally composed of units wherein a dimension of the first connector means along said lengthwise direction is substantially much larger than that of the unit of the second connector means along the same lengthwise direction; and a plurality of contacts extending from the first connector means and the second connector means; wherein a lengthwise dimension of each unit of the second connector means is designedly set to be a specific value whereby the dimension of the first connector means along the lengthwise direction is substantially equal to a full lengthwise dimension of the second connector means which is a sum of all the dimensions of said units of the second connector means along the lengthwise direction.

12. The system as described in claim 11, wherein said first connector means is a D-Sub connector and said second connector means is an audio jack assembly composed of three simplex audio jack units.

13. The system as described in claim 12, wherein said upper section includes a pair of securement posts defining a space therebetween to receiving therein a housing of said D-Sub connector, and said lower section includes a cavity facing downward for receiving said body of said audio jack assembly therein.

14. A bracket for use with arrangement of different connectors, comprising:

an insulative housing including an first section and a second section, said first section defining a space for receiving a first connector means, and said second section defining a cavity for receiving a second connector means; wherein said second connector means is generally composed of plural simplex units with a body to integrate said units together, and said second section has means in said cavity to cooperate with the body of the second connector means for orientation of said second connector means in said cavity, and said means are blades.

15. The bracket as described in claim 14, wherein said second section is defined by a front wall, a rear wall and two sides walls and wherein a plurality of opening formed in a front wall of the bracket.

16. The bracket as described in claim 14, wherein said second section further includes a plurality of lugs for retaining the second connector means in the cavity.

17. The bracket as described in claim 14, wherein said first section includes a pair of securement posts.

18. The bracket as described in claim 16, wherein said bracket further includes a pair of channels for receiving a corresponding pair of mounting legs therein.

19. A semi-finished system for arrangement of a first and a second connector means, comprising:

a bracket including a first section and a second section wherein the first section defines a space therein for receiving the first connector means, and the second section includes a front wall, a rear wall and two side walls for defining a facing downward cavity therein for receiving the second connector means;

the second connector means being an audio jack assembly composed of plural audio jack simplex units with an integral body; wherein said bracket further includes a plurality of blades in the cavity for engagement within corresponding grooves in the body of the second connector means.

20. The semi-finished system as described in claim 19, wherein said second connector means can be fixed within the cavity by means of lugs of the bracket abutting against a bottom surface of the body.

21. The semi-finished system as described in claim 19, wherein a plurality of opening are formed in the front wall for allowing mating portions of the second connector means to project outwardly.

22. A system for arrangement of different Input/Output connectors, comprising:

a bracket including an upper section and a lower section;

a first connector means secured to the upper section;

a second connector means secured to the lower section; and said first connector means and said second connector means including a plurality of contacts extending downward, respectively; wherein the upper section comprises a pair of securement posts and a pair of boardlocks are fixed to said pair of securement posts, respectively, and each of said boardlocks further includes a mounting leg having tangs latchably engaged within a channel in the bracket.

* * * * *